US005181297A

United States Patent [19]

Andrews, Jr. et al.

[11] Patent Number: 5,181,297

[45] Date of Patent: Jan. 26, 1993

[54] CONNECTOR CLIP FOR WASTE RECEPTACLES

[75] Inventors: Howard W. Andrews, Jr., Winchester; John A. Kowalski, Stephens City; Friedrich G. Wahl, Boyce, all of Va.

[73] Assignee: Rubbermaid Commercial Products Inc., Winchester, Va.

[21] Appl. No.: 712,456

[22] Filed: Jun. 10, 1991

[51] Int. Cl.[5] ..... B65D 21/02

[52] U.S. Cl. ..... 24/336; 24/555; 24/563; 220/23.4

[58] Field of Search ..... 220/908, 23.4; 24/336, 24/339, 545, 555, 563, 288, 456

[56] References Cited

U.S. PATENT DOCUMENTS

| | | | |
|---|---|---|---|
| 1,693,098 | 11/1928 | Taylor | 24/563 X |
| 1,794,285 | 2/1931 | Foster . | |
| 1,800,109 | 4/1931 | Selig . | |
| 2,566,804 | 9/1951 | Flamme et al. . | |
| 3,038,599 | 6/1962 | Poupitch . | |
| 3,146,505 | 9/1964 | Hansen . | |
| 3,636,595 | 1/1972 | Wines | 24/555 |
| 3,739,431 | 6/1973 | Scioloro . | |
| 4,115,938 | 9/1978 | Belmuth et al. . | |
| 4,227,758 | 10/1980 | Clare . | |
| 4,750,638 | 6/1988 | Sosower . | |
| 4,834,253 | 5/1989 | Crine . | |
| 4,834,262 | 5/1989 | Reed . | |
| 4,874,111 | 10/1989 | Heller . | |
| 4,925,056 | 5/1990 | McCoig . | |
| 4,940,159 | 7/1990 | Callas et al. . | |
| 4,967,900 | 11/1990 | Gossett . | |
| 4,969,568 | 11/1990 | Yoshida . | |
| 5,054,636 | 10/1991 | Netzer | 220/23.4 |
| 5,056,198 | 10/1991 | Viglione | 24/336 |

FOREIGN PATENT DOCUMENTS

| | | | |
|---|---|---|---|
| 2008143 | 9/1971 | Fed. Rep. of Germany | 220/23.4 |
| 37878 | 3/1912 | Sweden | 24/336 |
| 122647 | 9/1948 | Sweden | 24/555 |

*Primary Examiner*—James R. Brittain
*Attorney, Agent, or Firm*—Richard B. O'Planick

[57] ABSTRACT

A connector clip for connecting waste receptacles is disclosed, comprising an elongate body 2 of substantially M-shape in cross-section, having inverted U-shaped attachment portions 4,6 extending from a central connective loop portion 8. The portions 4,6 clamp over upper rims of two receptacles, whereby placing the receptacles in a side by side optimal spacing, and the elastomeric composition of the clip provides a positive connection with the receptacles, yet enables one receptacle to be disconnected from the other if so desired. The attachment portions 4,6 and the connective portion 8 define a longitudinal channel 30 which is open at the top and opposite ends, whereby admitting the upper edge of a plastic garbage bag positioned in one or both of the receptacles.

5 Claims, 3 Drawing Sheets

CONNECTOR CLIP FOR WASTE RECEPTACLES

BACKGROUND OF THE INVENTION

1. Field of the Invention

The present invention relates generally to a connector for joining two or more receptacles or containers, and more specifically to a connector for adjoining waste receptacles of the type intended to contain refuse.

2. The Prior Art

In recent years, environmental concerns have increased public awareness of the need for recycling certain constituent materials in products which are destined for disposal, in order to reduce waste and conserve resources. Recycling of materials such as glass, beverage cans, paper, etc. requires that such materials be separated by the consumer or the collection agency.

Recyclable refuse, in the United States, is commonly collected in refuse containers, and often within plastic bags placed within such containers, with upper edges of the bag rolled over an upper rim of the receptacle. To make the task of separating recyclable materials easier, a need has arisen for a multiple receptacle system into which plastic bags may be placed for receipt of separated trash. Ideally, the receptacles would be joined in some manner to conserve space, to prevent individual containers from tipping over in use or becoming separated, thus reducing ease of refuse separation. Further, such a system should be adaptable to existing refuse containers already in use; capable of expansion to more than two containers, depending on the need; and capable of securely connecting the multiple containers together, yet allowing for easy separation when necessary. An optimal system for interconnecting recycling containers should furthermore allow for the removal and replacement of the plastic bags inside the containers without requiring that they be disconnected. To enhance the utility of the containers, the system should preserve the containers in an optimal relative spacing and resist forces which would tend to disrupt that spacing.

Means for connecting receptacles and containers of one sort or another have been known for many years. Generally, such connective devices clamp or attach to two or more containers by attachment mechanisms, and include a connective rigid body extending between the attachment mechanisms.

U.S. Pat. No. 3,038,599 discloses a rigid can carrier clip for connecting several cans. The clip comprises a triangular shaped connective body to which alternating over and under hook projections are formed. The hook projections engage over and under the rim of the can to attach thereto.

U.S. Pat. No. 3,739,431 shows another holder configuration representative of the state of the art. The holder is in the form of a double end clip, formed of metal rod stock, and includes a central connecting portion and pairs of depending arms formed to extend outwardly therefrom. The depending arms straddle the rims of adjacent trash cans to join the cans together, and inhibit separation.

U.S. Pat. No. 1,800,109 teaches yet another clamping mechanism for joining two cans together, comprising remote inverted U-shaped pairs of clamping legs joined across the top by a bridging portion.

While the above patented devices all function to connect containers or receptacles together, and could conceivably be used in a recycling system, several shortcomings inherent to all prevent the configurations from adequating solving the industry's needs. First, existing means for connecting waste receptacles are not compatible in use with the practice of placing plastic bags in containers, and removing them when filled. Moreover, state of the art interconnection devices are composed of rigid material, making them adequate to hold the containers in a set spacing, but incapable of adapting to stress forces introduced into the system. Other requisites, such as the capability of permitting one container to be disconnected or moved without the others, and the capability of a system to accept any number of containers are likewise not achieved by available interconnection devices.

SUMMARY OF THE INVENTION

The present invention satisfies the needs of the industry by providing a connector clip for two waste receptacles. The clip is an elongate body of substantially M-shape cross-section, comprising inverted U-shape attachment portions separated by an intermediate connective loop portion. The attachment portions attach over upper rims of two receptacles, whereby placing the receptacles in a side by side optimal spacing. The clip is composed of elastomeric material, such that the connective loop portion flexes and absorbs stress if one connector happens to move relative to the other, whereby inhibiting an unintentional separation of the clip from the waste receptacles and maintaining the receptacles in the original optimal spacing. The resiliency of the clip and the enlarged shape of the connective loop thereof establishes a positive connection with the outwardly downturned rim flanges of the waste receptacles, yet enables one receptacle to be readily disconnected from the other if so desired.

The attachment portions and the connective loop portion define a longitudinal channel which is open at the top and opposite ends, whereby admitting the upper edge of a plastic garbage bag situated in one or both of the receptacles. The connective loop portion provides horizontal sections which intersect the opposed attachment portions at generally right angles, whereby defining shoulders over which the upper edges of the plastic bags can be extended and retained.

Accordingly, it is an objective of the present invention to provide a connector clip for adjoining two waste receptacles and spacing the containers apart an optimal distance.

Yet a further objective is to provide a connector clip having integral means for absorbing stress caused by the movement of one container relative to another, without the clip becoming disconnected.

A further objective is to provide a connector clip for connecting two waste receptacles, having positive means of attachment to upper rims of the receptacles.

Still a further objective is to provide a connector clip for joining two waste receptacles, the clip accepting and accommodating the use of plastic bags in the receptacles.

Yet a further objective is to provide a connector clip for joining two waste receptacles and accommodating the removal of filled plastic bags from the receptacles without disconnection of the receptacles from the clip.

A further objective is to provide a connector clip for joining two waste receptacles which can facilitate the disconnection of one waste receptacle from the other without removal of the clip.

Another objective is to provide a connector clip and waste container system which is indefinitely expandable by the addition of further containers and clips.

Yet another objective is to provide a connector clip for joining waste containers which is integrally molded of conventional plastics material, and which requires no additional hardware in application.

A further objective is to provide a connector clip for connecting waste receptacles which is inexpensive to manufacture and which is readily assembled in use.

These and other objectives, which will be readily appreciated by those skilled in the art, are achieved by a preferred embodiment which is described in detail below, and which is illustrated by the accompanying drawings.

DESCRIPTION OF THE PREFERRED EMBODIMENT

Figure 2:
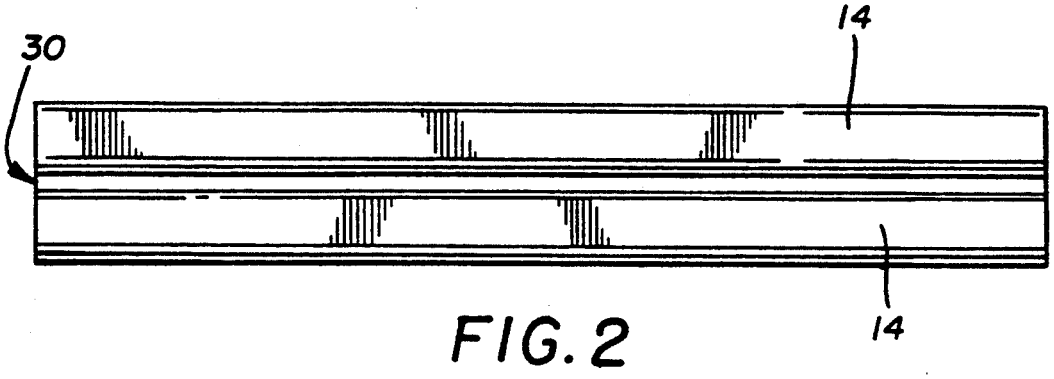
FIG. 2 is a top plan view of the connector clip.
Figure 3:
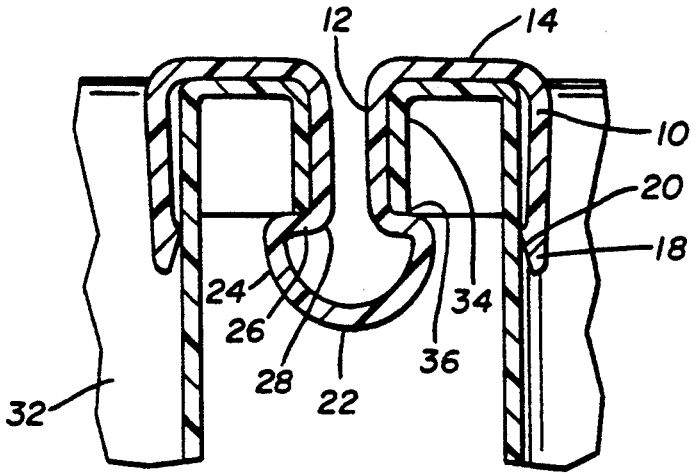
FIG. 3 is a transverse section view through the connector clip and waste container system illustrated in FIG. 1, taken along the line 3—3.
Figure 4:
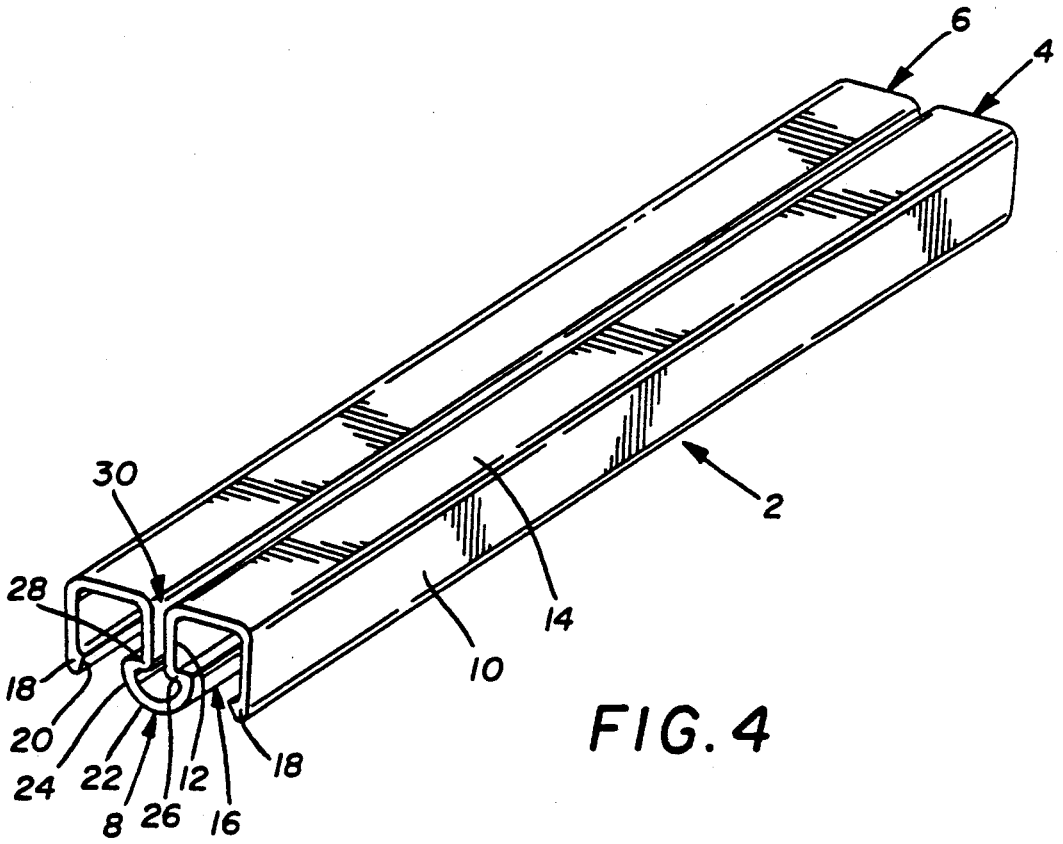
FIG. 4 is an enlarged perspective view of the connector clip component.

Referring initially to FIGS. 2,3, and 4, the connector clip 2 of the subject system is of generally M-shaped in cross-section, and elongate in profile. The clip 2 comprises spaced apart attachment clip portions 4, 6, of mirror image, each substantially of inverted U-shape. For the purposes of this specification, accordingly, description of, and reference to, the structure and function of one of the attachment portions shall apply also to the other. The attachment clip portions 4,6 are symmetric about a longitudinal axis of the clip, and are integrally joined together by an intermediate connective web portion 8. It will be appreciated that the web portion 8 is shaped generally as an enlarged loop, for a purpose explained below. The clip portions 4, 6, while shown to be identical and symmetrically disposed about portion 8, may be configured as alternatively shown in FIG. 5, for the purpose explained likewise below.

Each attachment portion 4,6 comprises an inwardly disposed first vertically extending leg 10, an outwardly disposed second vertically extending leg 12, and an intermediate horizontally extending connective bight portion 14. The legs 10,12, and bight portion 14 define an elongate channel 16 which extends the length of the clip 2. Extending along an inward lower end of the inward first leg 10 is a lead-in flange 18 having an upwardly ramped bottom lead-in surface 20.

The connective web portion 8 is configured as an enlarged loop, comprising a downwardly concave bottom surface 22 and horizontally extending end portions 26. The bottom surface 22 includes outwardly directed surface portions 24 which function as lead-in surfaces and cooperate with lead-in flange surfaces 20 when attachment portions 4 are clipped over upper rims of waste receptacles. It will be appreciated that horizontal end portions 26 extend from upper ends of the concave surface 22 inwardly to connect with bottom ends of outward legs 12. The intersection of horizontal portions 26 with legs 12 forms radiused shoulders 28. The angle between the horizontal portions 26 and the corresponding legs 12 is preferably ninety (90) degrees. The loop formed by connective portion 8 is enlarged relative to the spacing between the legs 12, whereby forming the shoulders 28.

In the preferred embodiment, a longitudinal channel 30 extends along the longitudinal axis of the connector clip 2, defined by legs 12 and the connective portion 8. The channel 30 opens to the top along the entire length of the clip 2, and is open at both ends.

Figure 1:
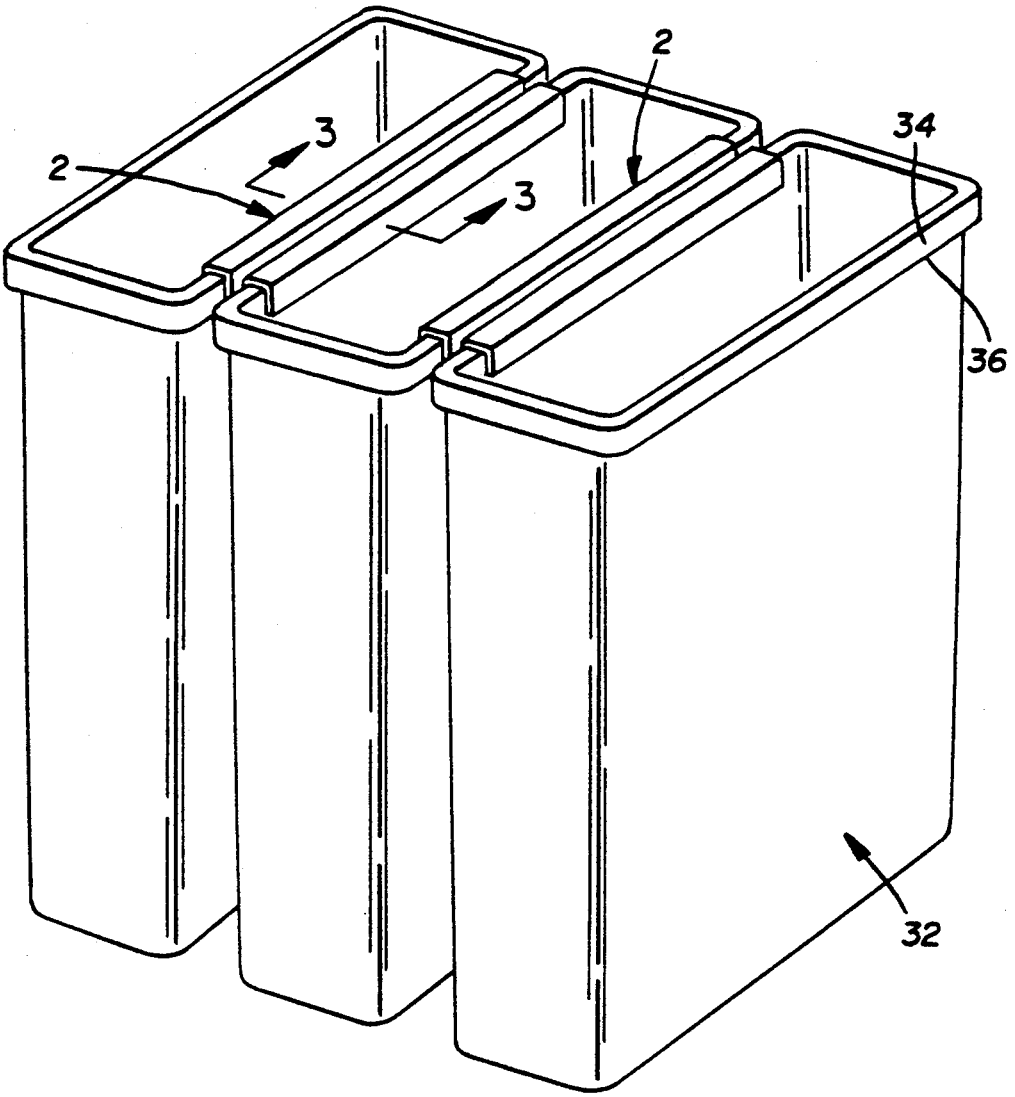
FIG. 1 is a perspective view of the connector clip and waste container system illustrating the subject invention in use.

Referring to FIGS. 1 and 3, the connector clip is intended to connect two receptacles 32 in a side-by-side relationship. While intended for serve recycling applications, wherein the receptacles 32 are for separating recyclable trash or waste, uses for the subject connector clip are not to be so restricted. Any application which requires the joining of rimmed containers can utilize the teachings set forth herein. Each receptacle 32 has an outwardly directed downturned rim flange 34 terminating at a lower edge. Such containers are commercially available and are in common use.

To assemble the connector clip 2 to the waste receptacles 32, the receptacle rim flange 34 is centered below the attachment legs 10,12 of the clip, and a downward force is applied to the bight portion 14 of the clip. The lead in surface 20 of leg 10 and the connective portion surface 24 engage the rim flange 34 and spread the legs 10,12 apart, facilitating installation and removal of the clip. The spacing between the bight portion 14 and the horizontal surface portion 26 is such that, when the bight portion 14 engages or is generally above the top of the receptacle rim, the looped connective portion 8 clears the rim bottom edge 36. The connective portion 8 thereupon positively attaches the clip to the upper rim of the receptacle. The opposite side of the clip is similarly attached to the other receptacle rim. It will be appreciated that the clip is dimensioned such that the bight portion 14 corresponds to accept the top width of the rim flange 34 of the receptacles for which the clip is intended, and the length of the leg 12 corresponds to accept the vertical depth of the flange 34.

The legs 10,12 may extend to three-fourths the depth of the receptacles to be joined. However, the legs work better at a preferable length of one-third the depth of the container or less. A typical length is 1.25 inches. An optimum width for the clip is approximately three inches or less, although the clip can have a greater or less width if desired as a function of the containers to be joined.

After installation, the two receptacles are positioned adjacent to one another, in a spacing determined by the connector clip portion 8. Additional receptacles can be connected to other sides of the connected receptacles by the use of a second, third, or fourth connector clips. In this manner, multiple receptacles can be added or removed from the system. Removal of a connector clip attachment portion 4 or 6 is achieved by the application of an upward force on the clip attachment portions 4,6, proximate thereto. The clip will allow separation of one container from the other without removal of the clip, which reduces the opportunity for loss of the clip, and further saves time. The non-symmetrical alternative configuration of FIG. 5 eases separation of one container from the other, if so desired.

The connector clip is conventionally molded of common plastics material, flexible enough to allow the clip to open easily, but stiff enough to allow retention of the clip to the containers. While plastics are preferable, any material with the above degree of flexibility and stiffness would be appropriate. Suitable plastics material can be taken from the classes including polyolefins, such as low and high density polyethylene, polypropylene, or polystyrenes, and other similar materials.

Referring to FIGS. 1 3, and 4, it will be readily apparent that the receptacle and clip system can facilitate use of polyliner bags (not shown) with the receptacles 32. The bags are placed in the receptacles, with top edges of the bags extended over a top rim of the receptacles and into the longitudinal channel 30 of the clip. The portion of the polyliner bag upper edge residing in the channel 30 is thereafter extended beneath the shoulders 28 of the clips. So extended, the edge of the bag is securely held until filled. The open top and ends of the channel 30 accommodate receipt of the bag top edge, and the shoulders 28 provide convenient lips over which the bag edge can be extended. The bag occupying one receptacle 32 may be removed individually without interfering with the bag in the adjacent container. It will further be apparent that the clip will allow removal of a polyliner bag without unclipping the containers.

The clip in the preferred embodiment is provided with connective portion 8, which functions in several capacities. First, it provides the center ledge (horizontal portions) 28 which traps the outside rim of the containers so the clip will be securely attached. The horizontal portions 28 can be dimensioned to any length but are, in the preferred embodiment, approximately 150 thousandths of an inch per side, or less to ease disengagement.

The connective portion 8 secondarily functions to separate the containers a specified distance. While the subject clip can function without the center separator, the separation provides a means of attachment of the clip to the receptacle rim, and also for a polyliner bag to be used with the container/clip assembly, as described above. The preferred depth of the separation loop is in proportion to the rim depth of the containers to be joined, on the order of one and one-half inches.

Thirdly, the radius at the bottom of the connective portion 8 provides a lead-in angle for installation purposes and as a flexible hinge which will permit movement between containers. The radius, approximately one-half inch in the preferred embodiment, acts as a resilient spring in absorbing stress caused by movement of one container relative to the other. The shape and disposition of the loop serves to dissipate both inwardly and outwardly directed forces, whereby assuring that the clip remains attached to the rims of both receptacles, and that the receptacles return to their intended spacing.

The overall length of the clip is determined by the product upon which it is to be attached. The optimum length of the clip is close to the overall length of the container side to which it attaches. Such a length improves stability of the assembly, and retention of the clip.

From a consideration of FIG. 1 it will be appreciated that the use of connector clips 2 joins receptacles 32 into a unitary array, suitable for providing multiple separate compartments for use in waste separation for recycling. The clips 2 serve as a double hinge, and receptacles so connected are more stable than if they are merely positioned adjacent to one another. The stress compensating characteristics of the resilient clip compensates for minor movement of one container relative to the other. The clip provides positive attachment means, accommodates the use of bags in, and removal from, the containers, and allows one container to be disconnected at a time. The subject clip is inexpensive to produce by extrusion or injection molded, of conventional plastics material.

Figure 5:
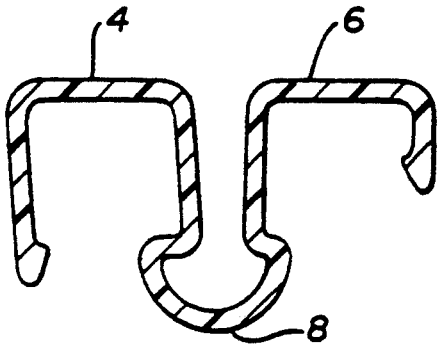
FIG. 5 is a transverse section view through an alternatively configured clip, having non-symmetric clip portions.

Referring to FIG. 5, an alternative embodiment of the clip is shown, wherein the clip portions 4,6 are asymmetric about web portion 8. The clip portion 6 is shown to have a shortened outward leg, which makes the disconnection of portion 6 from its associated container rim easier. In practice, the user may elect to disconnect the portion 6 from one container, which is then emptied, and leave the clip attached to the second container at portion 4. The shortened outward leg of portion 6 facilitates easy separation, while the longer outward leg of portion 4 ensures that the clip will remain attached securely to the second container. In general, the longer the outward leg of portions 4,6 is made, the more secure the connection. Conversely, a shorter length will allow the container rim to be more easily disengaged.

While the above describes the preferred embodiment of the present invention, the scope of protection is not to be so limited. Other embodiments, which will be apparent to one skilled in the art, and which utilize the teachings herein set forth, are intended to be within the scope and spirit of the present invention. Moreover, the dimensions set forth herein in regard to the preferred embodiment are intended solely as optimal recommendations, and are not intended to preclude dimensional modifications obvious to those skilled in the art which otherwise utilize the subject teachings.

We claim:

1. A connector clip for adjoining waste receptacles or the like, comprising:

an elongate clip body of substantially M-shape in cross-section said body comprising spaced apart attachment portions adapted to attach over upper rims of first and second receptacles and affix thereto, whereby positioning said receptacles in side by side relationship;

said body further comprising an intermediate connective portion connecting bottom portions of opposed outward legs of said attachment portions and separating said opposed outward legs a prescribed distance, whereby maintaining said receptacles in a spaced apart relationship;

said connective portion being composed of resilient material, wherein said clip flexibly absorbing stress as one of the waste receptacles is moved relative to the other, whereby inhibiting unintentional separation of said clip from said waste receptacles, and said connective portion having a downwardly concave bottom surface and defining with said opposed outward legs a top-opening longitudinal channel adapted to receive a top edge of a refuse bag positioned in either, or both, of the receptacles; and said connection portion bottom surface extending outwardly beyond said outward legs of said attachment portions, and said connective portion further comprising inwardly directed horizontal portions connecting opposite upper ends of said bottom concave surface with bottom ends of said outward legs of said attachment portions.

2. A connector clip according to claim 1, wherein said attachment portions having an inverted U-shape, comprising an inwardly disposed first leg for positioning along an inward side of one waste receptacle, an intermediate bight portion for disposition over the upper rim of the waste receptacle, and said outward attachment portion leg positioned to extend downwardly along an outward side of said one waste receptacle.

3. A connector clip according to claim 2, wherein said horizontal portions of said intermediate connective portion and said bright portions of said attachment portions defining therebetween a space sufficient to closely receive an outwardly downturned rim flange of said waste receptacles therebetween.

4. A connector clip for adjoining waste receptacles or the like, of the type having outwardly downturned rim flanges, the clip comprising:

an elongate clip body comprising spaced apart attachment portions, each said attachment portion having a downwardly open U-shape comprising an inwardly disposed first leg for positioning along an inward side of one waste receptacle, an intermediate bight portion positioning over the upper rim of said one waste receptacle, and an outwardly disposed second log for positioning along an outward side of said one waste receptacle, said first and second legs being spaced apart a distance sufficient to receive said upper rim of said one waste receptacle therebetween;

said body further comprising an intermediate connective web portion composed of resilient flexible material, and connection bottom portions of opposed outward legs of said attachment portions, said connective portion spacing said receptacles apart a prescribed distance and flexibly absorbing stress as one of the waste receptacles is moved relative to the other, whereby inhibiting unintentional separation of said clip from said waste receptacle;

said connective portion extending outward from said bottom portions of said opposed outward legs of said attachment portions and beneath lower edges of said receptacle downturned rim flanges, whereby securely attaching said attachment portions to respective receptacles;

said intermediate connective portion and said outward legs of said attachment portions defining an upwardly open channel adapted to receive a top edge of a refuse bag positioned in either, or both, of the receptacles;

said connective portion connecting to said bottom portions of said opposed outward legs of said attachment portions at right angles, whereby defining opposed edges directed toward said channel over which said refuse bag edges being positionable to securely attach said bag edges to said clip.

5. A connector clip according to claim 4, wherein said channel opening to forward and rearward ends of said clip, whereby admitting said refuse bag edges into said ends of said channel.

* * * * *